US011745992B2

(12) United States Patent
Perrier

(10) Patent No.: US 11,745,992 B2
(45) Date of Patent: Sep. 5, 2023

(54) METHOD AND MACHINE FOR FILLING A CONTAINER TO A DESIRED LIQUID LEVEL

(71) Applicant: PEP TECHNOLOGIES, Le Cheylard (FR)

(72) Inventor: Philippe Perrier, Le Cheylard (FR)

(73) Assignee: PEP TECHNOLOGIES, Le Cheylard (FR)

( * ) Notice: Subject to any disclaimer, the term of this patent is extended or adjusted under 35 U.S.C. 154(b) by 9 days.

(21) Appl. No.: 17/642,970

(22) PCT Filed: Sep. 17, 2020

(86) PCT No.: PCT/FR2020/051605
§ 371 (c)(1),
(2) Date: Mar. 15, 2022

(87) PCT Pub. No.: WO2021/053297
PCT Pub. Date: Mar. 25, 2021

(65) Prior Publication Data

US 2022/0332560 A1 Oct. 20, 2022

(30) Foreign Application Priority Data

Sep. 19, 2019 (FR) ..... 1910323

(51) Int. Cl.
*B67C 3/28* (2006.01)
*B67C 3/06* (2006.01)
(Continued)

(52) U.S. Cl.
CPC ..... *B67C 3/286* (2013.01); *B67C 3/06* (2013.01); *B67C 3/12* (2013.01); *B67C 3/2614* (2013.01);
(Continued)

(58) Field of Classification Search
CPC .. B67C 3/286; B67C 3/06; B67C 3/12; B67C 3/2614; B67C 3/2628; B67C 3/2654; B67C 3/26; B67C 3/22
See application file for complete search history.

(56) References Cited

U.S. PATENT DOCUMENTS 1,978,002 A * 10/1934 Weaver ..... B67C 3/24 141/49
2,794,453 A * 6/1957 Grosbois ..... B67C 3/2628 141/303
(Continued)

FOREIGN PATENT DOCUMENTS

DE 1 185 497 1/1965
DE 44 02 980 6/1995
(Continued)

*Primary Examiner* — Nicolas A Arnet
(74) *Attorney, Agent, or Firm* — Clark & Brody LP

(57) ABSTRACT

A filling machine includes a filling tube passing through a spout endpiece to delimit with the spout endpiece, part of an air return circuit. The filling tube is vertically movable and delimits an exit passage for the liquid. A control circuit is provided for moving the filling tube to a low position and driving an obturation device to open the exit passage, putting the air return circuit, when the exit passage of the filling tube is immersed in the liquid, to atmospheric pressure, moving the filling tube towards its leveling position, putting the air return circuit in communication with a pressurized chamber, and bringing the filling tube to a leveling position.

15 Claims, 11 Drawing Sheets

(51) Int. Cl.
*B67C 3/26* (2006.01)
*B67C 3/12* (2006.01)

(52) U.S. Cl.
CPC .... *B67C 3/2628* (2013.01); *B67C 2003/2654* (2013.01)

(56) References Cited

U.S. PATENT DOCUMENTS

| | | | | | |
|---|---|---|---|---|---|
| 3,516,455 | A * | 6/1970 | Carter | B67C 3/06 | 141/90 |
| 3,886,982 | A * | 6/1975 | Uth | B67C 3/06 | 141/303 |
| 4,363,339 | A * | 12/1982 | Puskarz | B67C 3/2628 | 141/303 |
| 4,693,054 | A * | 9/1987 | Spargo | B67C 3/10 | 53/474 |
| 5,255,720 | A * | 10/1993 | McPherson | B67C 3/2608 | 141/89 |
| 5,445,194 | A * | 8/1995 | Clusserath | B67C 3/10 | 141/146 |
| 8,794,275 | B2 * | 8/2014 | Gruber | B67C 3/22 | 141/144 |
| 9,682,850 | B2 * | 6/2017 | Perrier | B67C 3/06 | |
| 11,370,646 | B2 * | 6/2022 | Doblinger | B67C 3/045 | |
| 11,427,453 | B2 * | 8/2022 | Dal Lago | B67C 3/2614 | |

FOREIGN PATENT DOCUMENTS

| | | |
|---|---|---|
| EP | 0 103 484 | 3/1984 |
| FR | 2 213 902 | 8/1974 |
| GB | 972 916 | 10/1964 |
| GB | 1 078 708 | 8/1967 |
| IT | B020 090 077 | 8/2010 |
| WO | 2016/030786 | 3/2016 |

* cited by examiner

[Fig. 1]
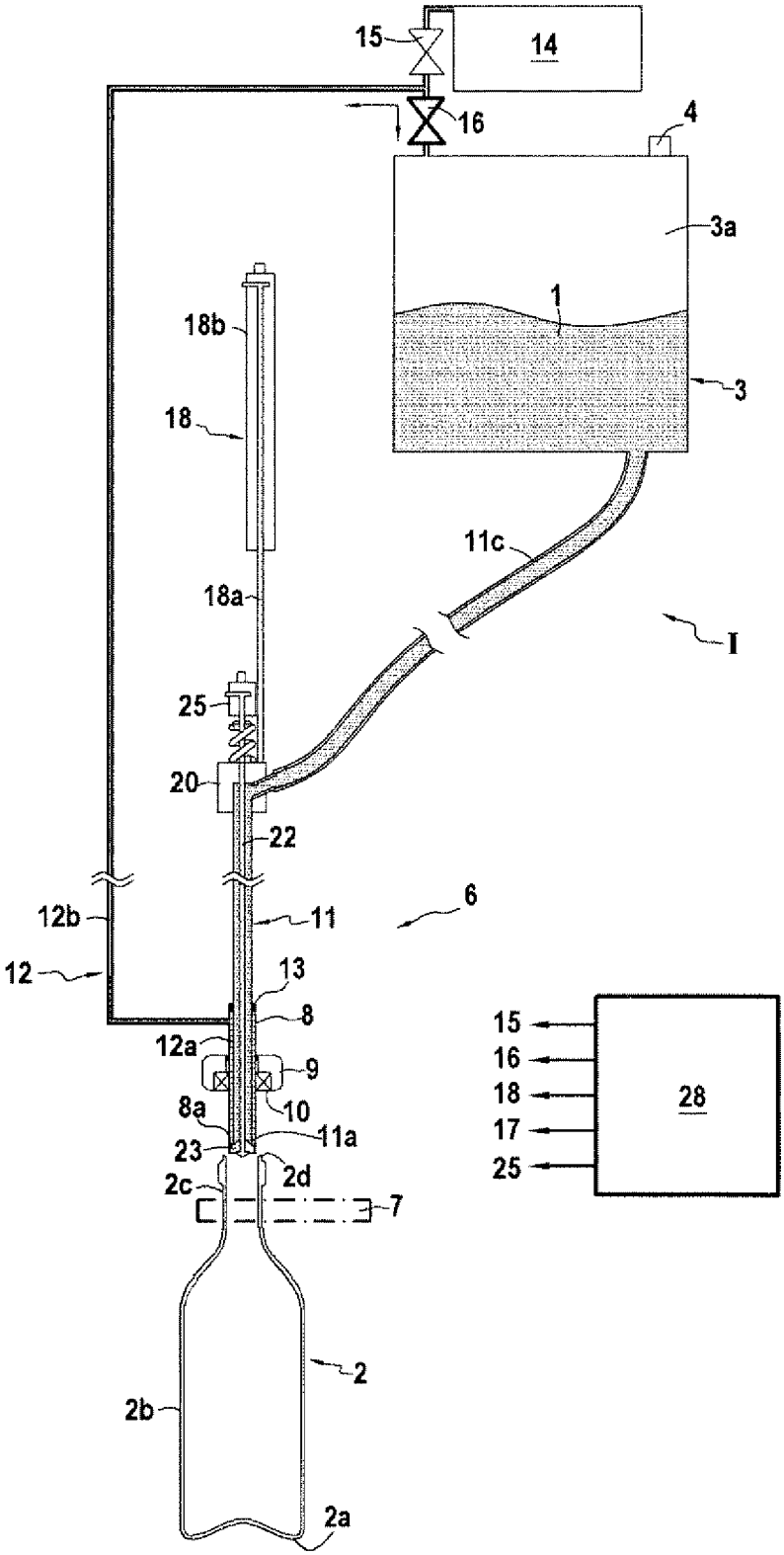

[Fig. 2]
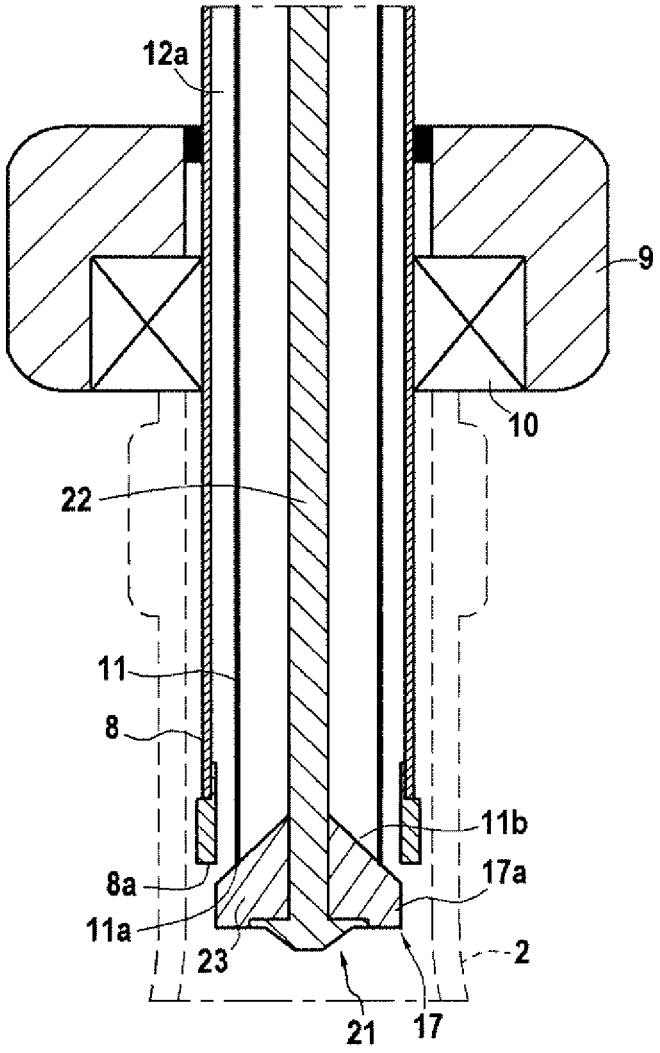

[Fig. 3]
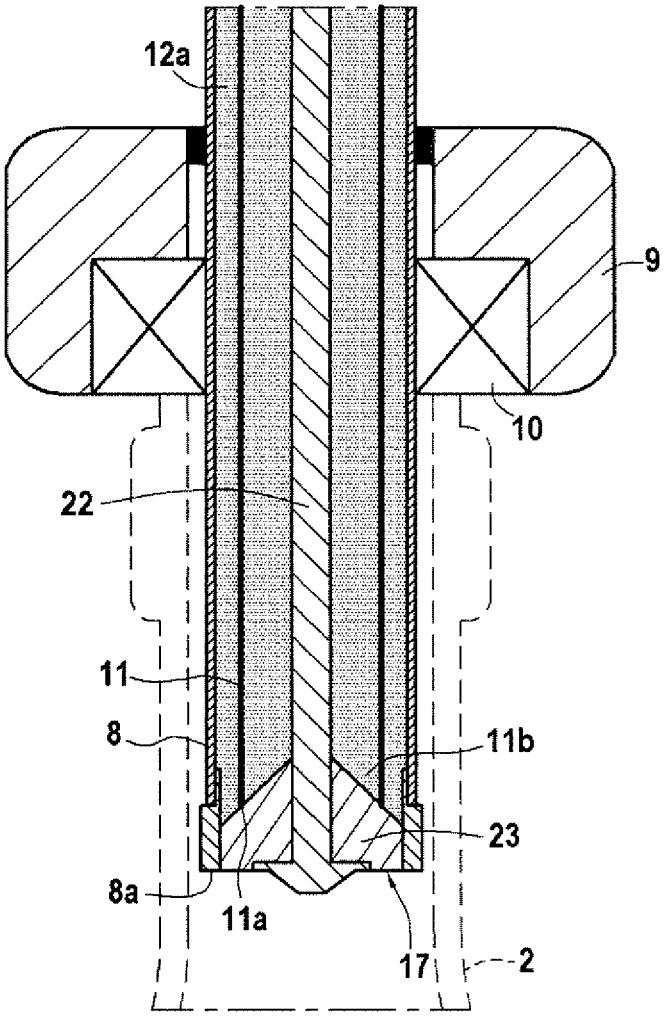

[Fig. 4]
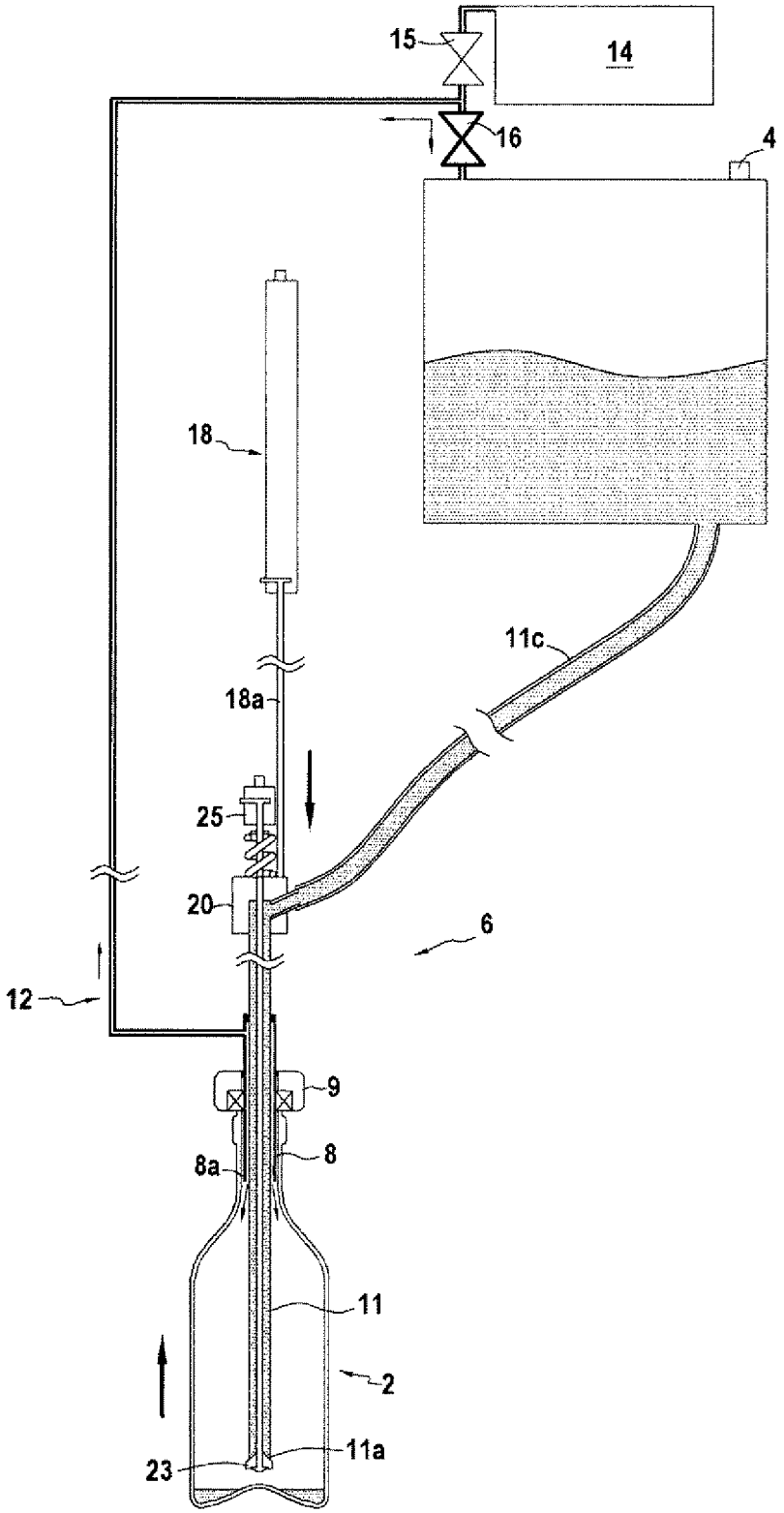

[Fig. 5]
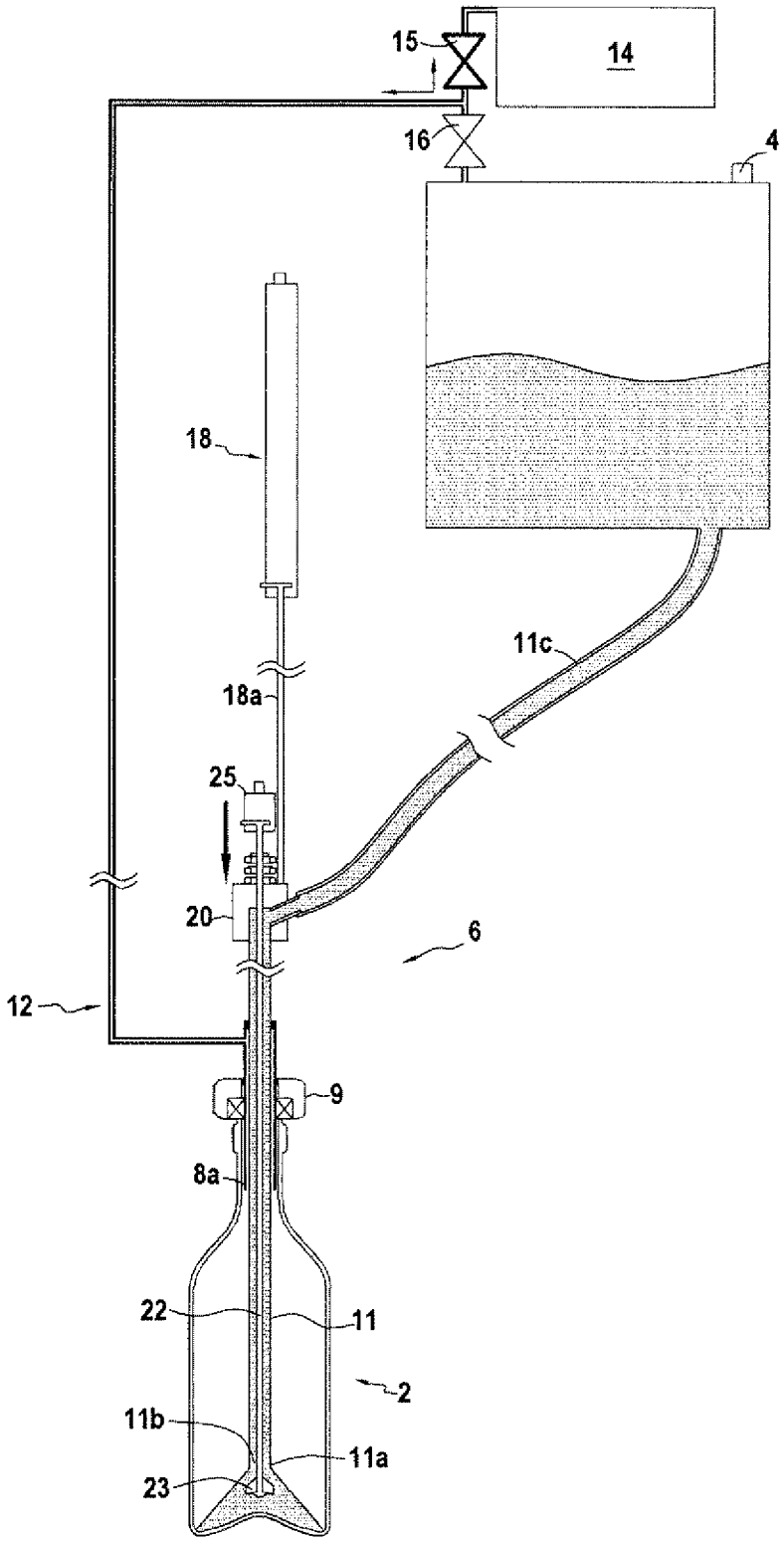

[Fig. 6]
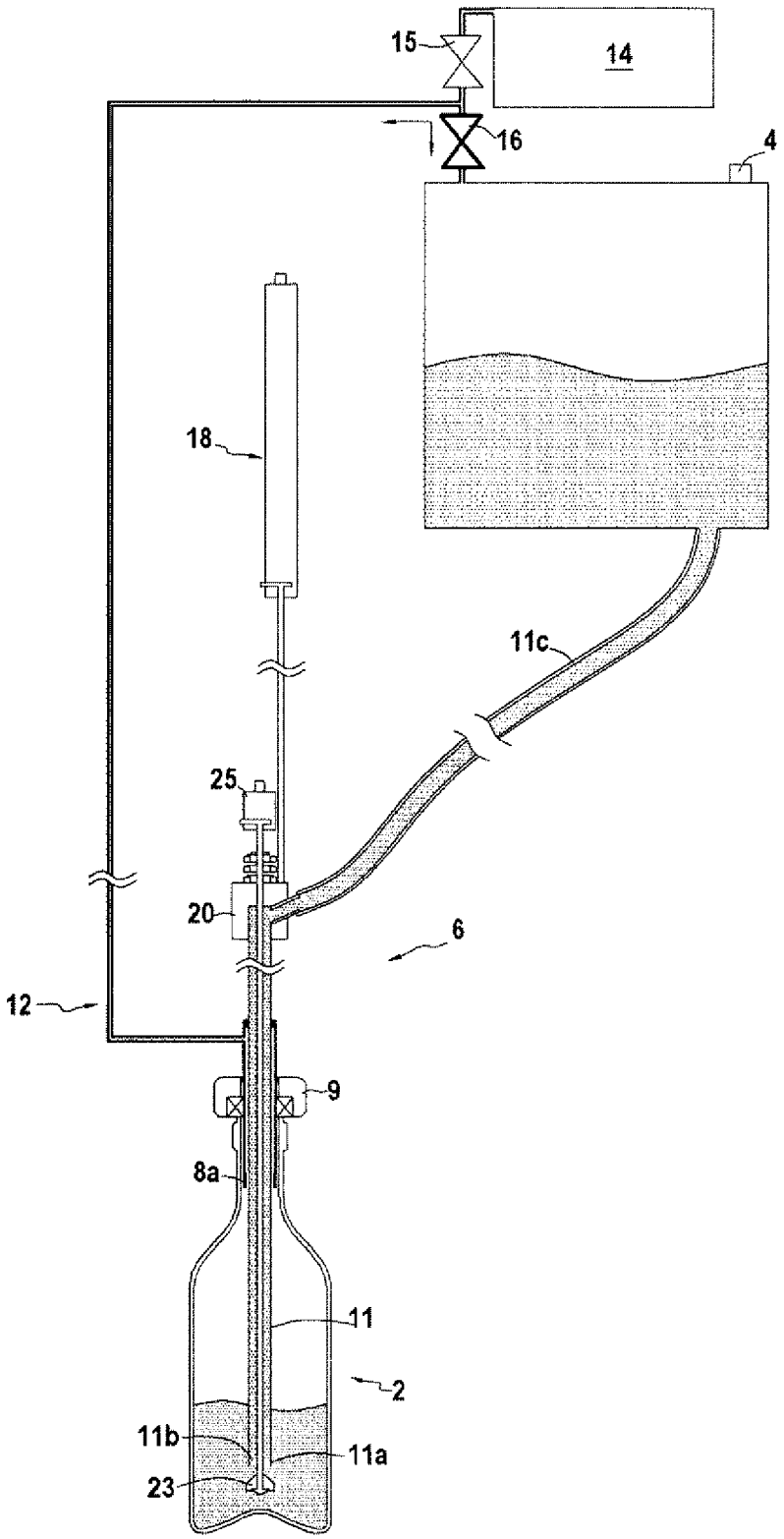

[Fig. 7]
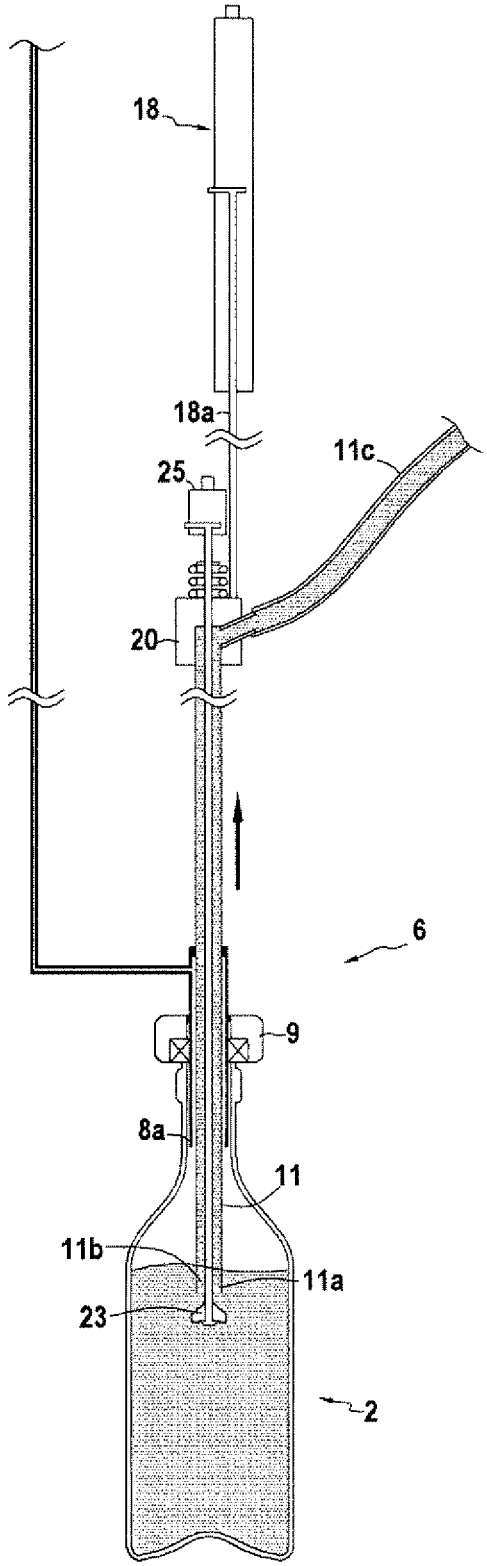

[Fig. 8]
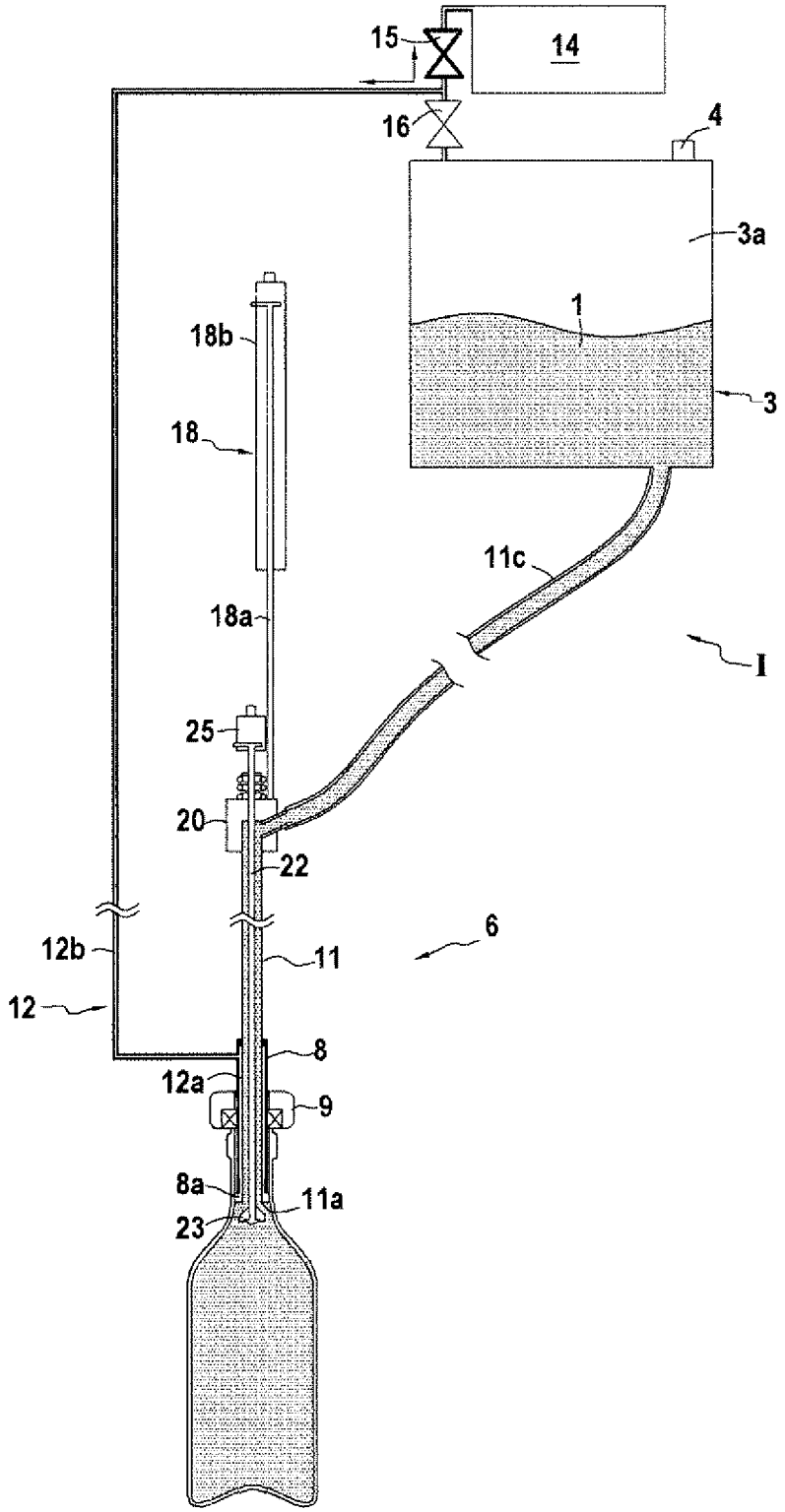

[Fig. 9]
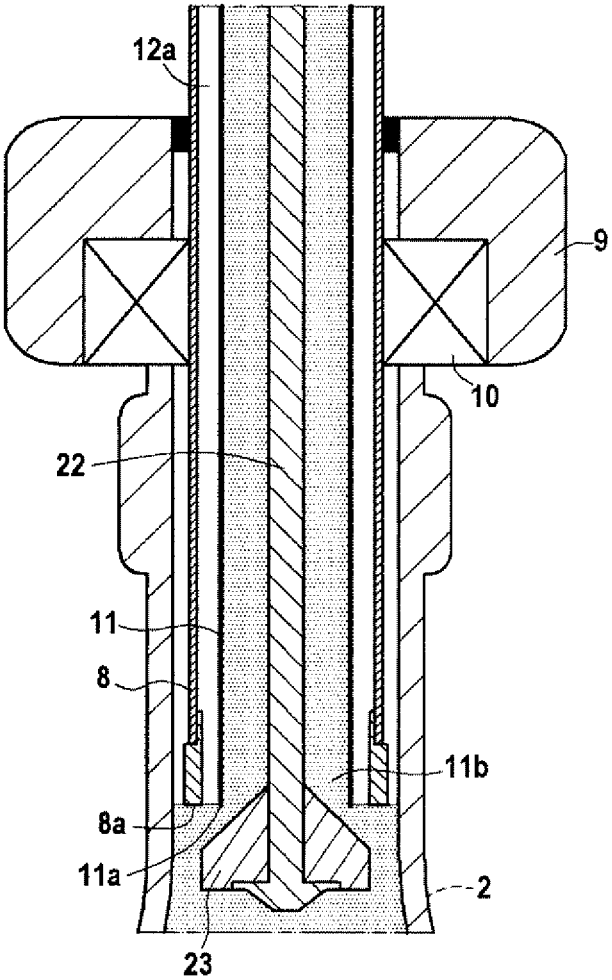

[Fig. 10]
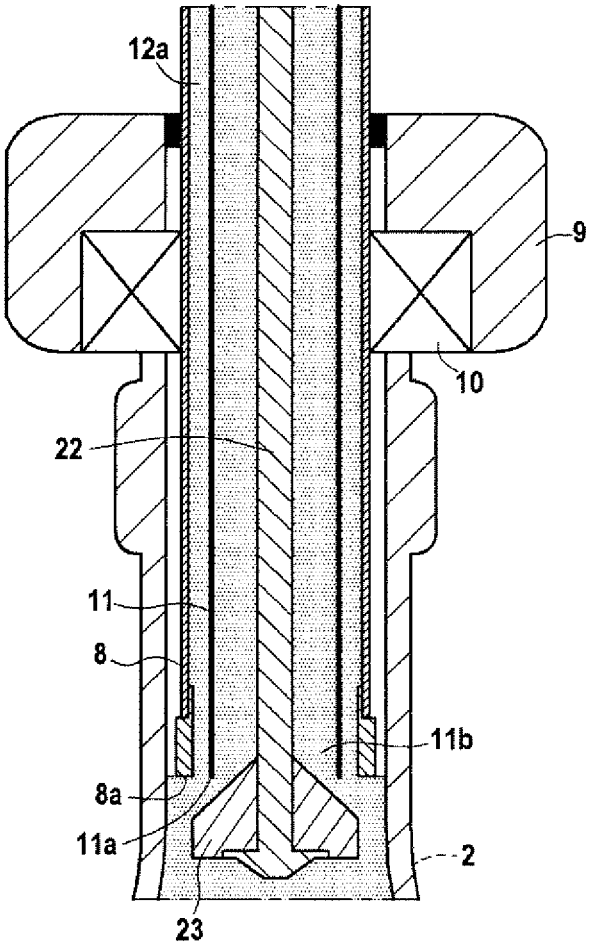

[Fig. 11]
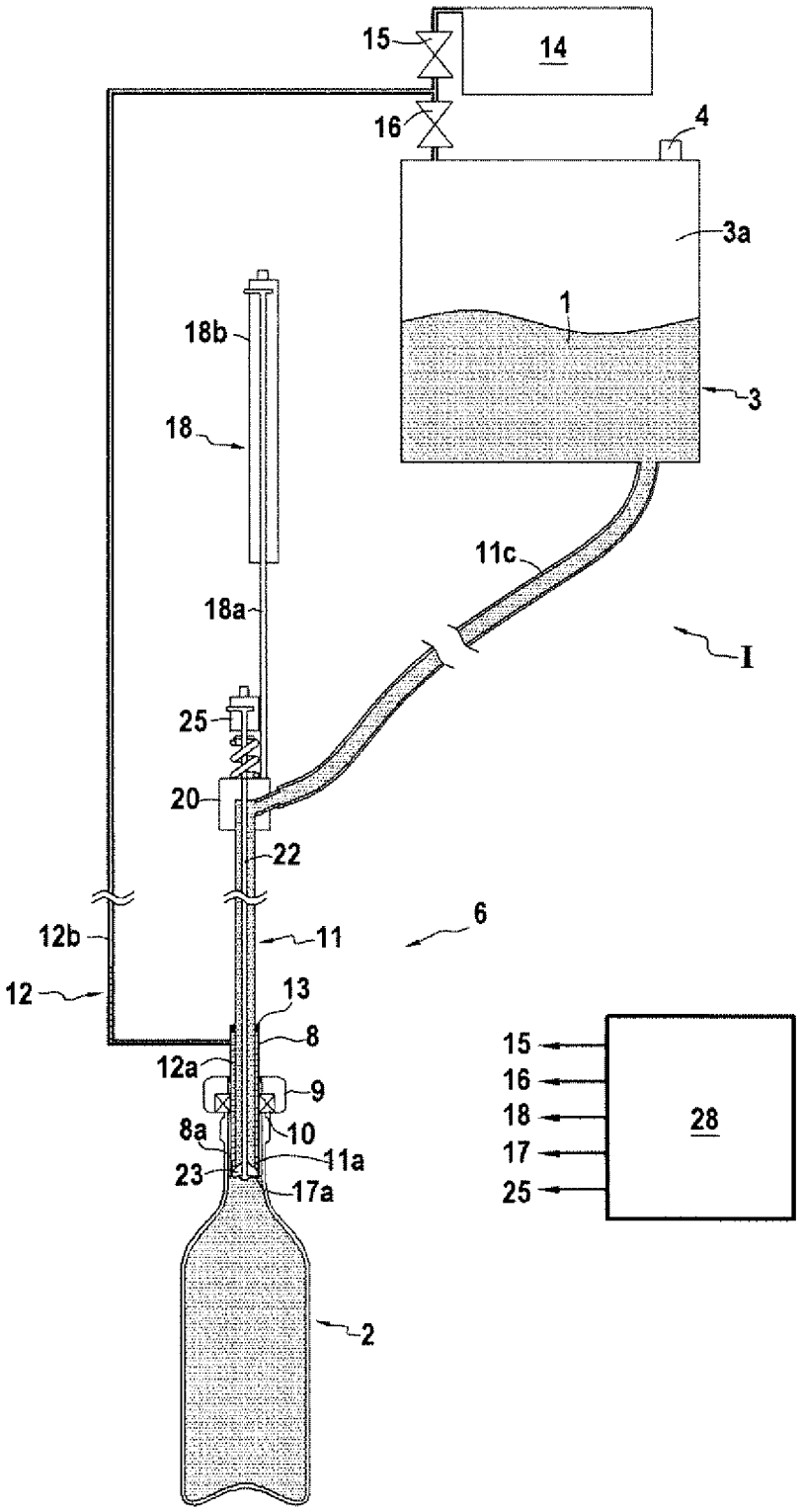

METHOD AND MACHINE FOR FILLING A CONTAINER TO A DESIRED LIQUID LEVEL

TECHNICAL FIELD

The object of the invention relates to the technical field of filling containers of any type known per se such as glass or plastic material containers, using a filling liquid of any kind. The object of the invention finds a particularly advantageous application for the filling of containers of all types of shapes and sizes with products sensitive to oxidation such as wines.

In the state of the art, many solutions have been proposed for filling and leveling a liquid inside containers.

PRIOR ART

For example, U.S. Pat. No. 1,978,002 describes a filling machine including a tank for storing a filling liquid. This storage tank is connected to one and generally a series of filling heads to each of which the containers are successively brought and then removed after filling. Each filling head includes a filling tube passing through a bearing seat for the neck of the container. The tube is intended to penetrate inside the container and includes internally a discharge cannula for recovering the air expelled from the interior of the container by the filling liquid. The vacuum is maintained inside the storage tank to ensure the flow of the liquid from the end of the filling tube. When the liquid reaches the lower end of the filling tube, the liquid passes through the discharge cannula to be brought to the tank or to a storage container. The level of the liquid inside the container is determined by the lower end of the filling tube.

It must first be considered that the filling of containers using the vacuum may affect the quality of the filling liquid due to the aeration of the liquid. Indeed, the vacuum modifies the gas equilibrium of some liquids and leads to a loss of aromas. In addition, the quality of the liquid is also affected by the recirculation of the liquid which occurs in the presence of the container on the receiving seat and even in the absence of the container, with a lower recirculation flow rate. Moreover, it appears that the filling operation turns out, in practice in particular at the end of the filling operation, to be relatively long given the creation of bubbles or foam making the leveling of the liquid difficult.

Document DE 11 85 497 describes a technique for filling containers using a filling liquid stored in a pressure-regulated tank and delivered using at least one filling head including a filling tube passing through a bearing seat for the container and provided with a main obturator to authorize or interrupt the passage of the filling liquid. The filling tube includes internally a discharge cannula and delimits externally with the bearing seat, a passage for communication with a circuit for a regulated leak for the container equipped with an obturator controlled to open and close. The discharge cannula is connected by controlled obturators either to a regulated leakage circuit for the cannula, or to a circuit for communication with the tank allowing the filling of the container in gravity mode. The obturator of the filling tube is driven by a controlled actuator.

The implementation of the technique described by this document leads to a relatively long filling operation given in particular the creation of bubbles or foam at the end of the filling operation.

In the wine bottling industry, it is known that oxygen absorption by wine should be reduced as much as possible during the filling phase. Known bottling machines currently use a filling method which essentially provides for a preliminary step during which an inert gas such as nitrogen is injected inside the container to expel the oxygen using a tube injector partially inserted into the neck of the container.

The neck of the container is then sealed by means of a filling valve which coaxially comprises the aforementioned nitrogen injection nozzle. The vacuum is then created inside the container and the wine is then poured into the container and flows over the surfaces of the inner walls of the container, from its neck to its bottom. The correct filling level is obtained by sucking the excess amount of wine from the container. This conventional method above has been described for example in the patent application WO 2016/030786 in which the filling of the container is carried out using a sliding tube inside the container with the liquid leaving the tube at the bottom of the bottle and then the level of the liquid rises up to the neck, thus reducing the turbulences which typically favor the absorption of oxygen. Such a method leads to a delicate implementation to manage the injection of nitrogen. Moreover, this method does not allow guaranteeing an accurate level for the final level of liquid inside the container due to the management of the regularity of the vacuum and the suction time.

DISCLOSURE OF THE INVENTION

The present invention therefore aims to overcome the drawbacks of the state of the art by proposing a new filling technique that does not have recourse to the injection of nitrogen while limiting the absorption of oxygen by the liquid, this method allowing a filling of the containers to a desired and reproducible level.

Another object of the invention aims to allow filling containers of all shapes and sizes.

To achieve such an objective, the object of the invention relates to a method for filling containers using a filling liquid stored in a tank and delivered using at least one filling head including a spout endpiece provided with a bearing seat for a neck of a container, the spout endpiece being crossed by a filling tube connected to the tank and delimiting with the spout endpiece, at least part of an air return circuit, the filling tube delimiting an exit passage for the liquid which is opened or closed by means of an obturation device, the method including the following steps for the filling of a container:

- making the neck of the container bear on the seat by engaging the spout endpiece inside the container;
- translating the filling tube inside the container from a high position to a low position in the vicinity of the bottom of the container;
- putting in communication with the interior of the container, the air return circuit put at atmospheric pressure so that it emptied of its liquid;
- when the filling tube occupies its low position, opening the exit passage of the filling tube in order to ensure the exit of the liquid and put the air return circuit in communication with a pressurized chamber to ensure a slow flow of the liquid;
- when the exit passage of the filling tube is immersed in the liquid, putting the air return circuit at atmospheric pressure to increase the flow of the liquid;
- moving the filling tube while keeping the liquid exit passage immersed, towards a leveling position for which the filling tube is engaged inside the container at a depth corresponding to the level of the liquid inside the container;
- during the filling end phase, putting the air return circuit in communication with the pressurized chamber to slow down the flow of the liquid and move the filling tube to its leveling position;

waiting for the stabilization of the liquid level with a return of liquid in the air return circuit before closing the air return circuit;

and closing the exit passage of the filling tube to stop the exit of the liquid.

In addition, the method according to the invention further includes in combination at least either or both of the following additional characteristics:

the container is disengaged from the spout endpiece after its filling before the engagement of a new container to be filled;

the filling tube is moved so that, in the leveling position, the lower end of the filling tube is at the level of the lower end of the spout endpiece;

the bearing seat is mounted in an adjustable position relative to the lower end of the spout endpiece to adjust the level of the liquid inside the container;

the filling tube is moved from its leveling position to the high position in order to ensure the closing of the air return circuit occurring automatically when the filling tube switches from its leveling position to the high position;

the filling tube is moved such that the high position corresponds to the leveling position;

the translation of the filling tube inside the container from the high position to the low position ensures the communication of the air return circuit with the interior of the container;

the container is sealingly bearing on the seat at least as long as the exit passage of the filling tube is open;

the exit passage of the filling tube is opened or closed by an obturator carried by a rod movable in translation relative to the tube in order to open or close the exit passage depending on the position of the rod relative to the filling tube.

Another object of the invention is to propose a machine for filling containers using a filling liquid stored in a tank, including at least one filling head, each filling head including:

a spout endpiece provided with a bearing seat for a neck of a container;

a filling tube connected to the tank and passing through the spout endpiece to delimit with the spout endpiece, part of an air return circuit connected either to the atmospheric pressure via a tank obturator, or to a pressurized chamber via a chamber obturator, the filling tube being vertically movable by means of a displacement actuator between, on the one hand, a high position and, on the other hand, a low position in the vicinity of the bottom of the container, the filling tube delimiting an exit passage for the liquid which is opened or closed by means of an obturation device;

a sealing system ensuring the closing of the air return circuit when the filling tube occupies the high closing position;

a control circuit connected to the chamber obturator, to the tank obturator, to the displacement actuator, to the obturation device and to the sealing system for:

moving the filling tube, during an initial filling phase, from its high closing position to its low position and driving the obturation device to open the exit passage of the filling tube, and putting the air return circuit in communication with the pressurized chamber;

putting the air return circuit, when the exit passage of the filling tube is immersed in the liquid, to atmospheric pressure and moving the filling tube towards its leveling position while keeping the liquid exit passage immersed;

putting the air return circuit, during the filling end phase, in communication with the pressurized chamber and bringing the filling tube to a leveling position of the liquid inside the container, with a return of liquid in the air return circuit, driving the sealing system to close the air return circuit and driving the obturation device to close the liquid exit passage.

In addition, the machine according to the invention may also have in combination at least either or both of the following additional characteristics:

the obturation device includes a rod mounted inside the filling tube and equipped at its lower part with an obturator and movable in translation relative to the filling tube by means of a filling actuator so that the obturator can open or close the exit passage of the filling tube depending on the position of the rod;

the sealing system includes a seal carried by the rod to close the air return circuit when the filling tube switches from its leveling position to its high closing position;

the bearing seat is mounted with a possibility of adjustment relative to the lower end of the spout endpiece to allow adjusting the level of the liquid in the container;

the filling tube is provided with a support for the rod and for the filling actuator;

the machine includes a container handling system for engaging each container into the spout endpiece and releasing each of the containers after their filling.

Various other characteristics emerge from the description given below with reference to the appended drawings which show, by way of non-limiting examples, embodiments of the object of the invention.

BRIEF DESCRIPTION OF THE DRAWINGS

FIG. 1 is a schematic view of the filling machine according to the invention before engagement of the container on the filling head.

FIG. 2 is a large-scale partial view of the filling head, with the filling tube in the closed position and with the air return circuit in the open position.

FIG. 3 is a large-scale partial view of the filling head, with the filling tube in the closed position and with the air return circuit in the closed position.

FIG. 4 illustrates the filling machine in the beginning of the filling phase showing the filling tube in the low position.

FIG. 5 illustrates the filling machine in a filling beginning phase for which the liquid flows in slow mode.

FIG. 6 is a view of the filling machine during a filling phase for which the liquid flows in accelerated mode.

FIG. 7 is a view of the filling machine similar to FIG. 6 showing the evolution of the filling.

FIG. 8 illustrates the filling machine at the end of the filling phase for which the liquid flows in slow mode.

FIG. 9 is a large-scale partial view of the filling head, showing the filling tube in its leveling position.

FIG. 10 is a large-scale partial view of the filling head, showing the course of the liquid in the air return circuit.

FIG. 11 is a schematic view of the filling machine after filling of a container, with the air return circuit in the closed position and the filling tube in the closed position.

DESCRIPTION OF THE EMBODIMENTS

As shown more specifically in FIG. 1, the object of the invention relates to a machine I intended to fill, using a liquid 1, a container 2 to a determined level. The container 2 can be of any kind such as plastic, glass or metal material. Conventionally, a container 2 is a hollow object including a bottom 2*a* connected to a heel or a chime from which a body 2*b* rises extending by a shoulder connected to a neck or collar 2*c* terminated by a finish 2*d* delimiting the mouth for filling or emptying the container. Similarly, the liquid 1 can be of any kind such as for example alcoholic, sugary, carbonated, flavored, colored liquid with or without particles, etc. Advantageously, the liquid 1 is a liquid sensitive to oxidation such as wine.

The filling machine I includes a storage tank 3 for the liquid 1, maintained at a regulation pressure by any suitable means 4 such as for example by a pressure regulator. Typically, the tank 3 is maintained at a pressure corresponding to atmospheric pressure.

The filling machine I also includes at least one and generally several filling heads 6 adapted to fill by gravity, each a container 2 with the liquid 1 leaving the storage tank 3 located at a higher level relative to the level of mounting of the filling heads 6. After its filling, each container 2 is evacuated and replaced by a new container for its filling. The filling machine I includes for this purpose, a container handling system 7 for bringing each container 2 to a filling head 6 and releasing each of the containers after their filling. This container handling system 7 can be produced in any suitable way. Advantageously, this handling system 7 includes, for each filling head 6, a gripper allowing the displacement of the containers through their collar.

The filling machine I is not described in more detail because it can take different shapes or configurations depending particularly on the number of filling heads 6. According to the following description, only the operation of a filling head 6 is described, but it is clear that the object of the invention can be applied to a machine including a series of filling heads, for example distributed along a line or at its periphery in order to produce the machine in the form of a carousel.

Each filling head 6 includes a spout endpiece 8 provided with a bearing seat 9 for the neck of the container. The spout endpiece 8 is produced by a tube or a cannula whose section is adapted to be able to be introduced into the container 2 through its neck. This spout endpiece 8 has a lower end 8*a* (FIG. 2).

The spout endpiece 8 is equipped externally with the bearing seat 9 which is provided with a bearing seal 10 for the container in the filling position. Thus, each container 2 bears through its neck or more specifically through its finish surface 2*d* on the bearing seal 10 so as to ensure a sealing between the spout endpiece 8 and the neck 2*c* of the container. Each container 2 is thus moved by the handling system 7 to engage the neck around the spout endpiece 8 and bear through its finish surface 2*d* on the seal 10. At the end of the filling operation, each filled container 2 is evacuated by the handling system 7 which ensures bringing the next container to the filling head.

According to one advantageous characteristic of embodiment, the bearing seat 9 is mounted with a possibility of adjustment relative to the lower end 8*a* of the spout endpiece 8 to allow adjusting the level of the liquid in the container. To this end, the bearing seat 9 is slidably mounted on the spout endpiece 8 with a blocking system in a predetermined position of any types known per se. For example, the spout endpiece 8 can include graduations to facilitate the positioning, in a defined position, of the bearing seat 9 relative to the lower end 8*a* of the spout endpiece 8.

Each spout endpiece 8 is crossed by a filling tube 11 communicating with the storage tank 3 and movably mounted in vertical translation. The filling tube 11 passes through the spout endpiece 8 to delimit therewith, a part 12*a* of an air return circuit 12 in communication with the interior of the container in order to place it at a determined pressure value according to the filling cycle, as will be explained in the following description. For this purpose, the spout endpiece 8 and the filling tube 11 extend coaxially to each other by delimiting therebetween an annular chamber 12*a* forming part of the air return circuit 12 (FIG. 2). A dynamic sealing system 13 is placed between the upper part of the spout endpiece 8 and the sliding filling tube 11 in order to close the upper part of the annular chamber 12*a*.

This air return circuit 12 also includes a pipe 12*b* of connection with the annular chamber 12*a* and connected either to the atmospheric pressure or to a pressurized chamber 14 via a chamber obturator 15. Advantageously, the connection pipe 12*b* is connected via a tank obturator 16, to the headspace 3*a* of the tank 3 whose pressure is maintained equal to atmospheric pressure. Thus, the air return circuit 12 is placed either at atmospheric pressure (via the tank obturator 16) or at a pressure value greater than the atmospheric pressure (via the chamber obturator 15).

According to another characteristic of the invention, a sealing system 17 ensures the closing of the air return circuit 12 when the filling tube 11 occupies a high position (FIG. 3). Such a sealing system 17 can be produced in any suitable way. A preferred exemplary embodiment will be described later in the description.

The filling tube 11 includes a lower end 11*a* delimiting an exit passage 11*b* for the liquid. The lower end 11*a* always extends below the bearing seat 9. Thus, the filling tube 11 thus extends in projection from the bearing seat 9 allowing the introduction of the filling tube 11 through its lower end 11*a* inside the container 2. In the example illustrated, the filling tube 11 is a rigid tube connected to the bottom of the tank 3 by means of a hose 11*c*.

The filling tube 11 is movable along a vertical direction using a displacement actuator 18 between a high position and a low position defined relative to the depth of engagement of the filling tube inside of the container. The high position of the filling tube 11 corresponds to the position in a filling cycle, for which the filling tube 11 occupies the highest position. This high position can correspond to the leveling position for which the filling tube 11 is engaged inside the container at a depth corresponding to the level of the liquid to be reached inside the container. The distance between the bearing seat 9 and the lower end 11*a* of the filling tube thus corresponds to the final height of the liquid inside the container 2. According to one preferred variant of implementation, in the leveling position, the lower end 11*a* of the filling tube is at the level of lower end 8*a* of the spout endpiece 8 as illustrated in FIG. 2.

The high position of the filling tube 11 may also correspond, according to one preferred variant of embodiment described in detail in the following description, to a position of the filling tube higher than the leveling position and for which the filling tube 11 obturates the air return circuit 12. In this high position called complete obturation position illustrated in FIG. 3, the sealing system 17 closes the air return circuit 12 between the lower end 11*a* of the filling tube and the lower end 8*a* of the spout endpiece 8.

The low position of the filling tube 11 corresponds to a positioning of the lower end 11*a* of the filling tube at the level of the bottom 2*a* of the container. Preferably, in this low position, the lower end 11*a* of the filling tube is not in contact with the bottom of the container but is in the vicinity of the pushed up bottom.

The displacement actuator 18 has a displacement stroke for positioning the lower end 11*a* of the filling tube 11 between this high position and this low position. In the example illustrated in the drawings, the actuator 18 is an electric cylinder, but it is clear that this actuator can be produced in any suitable way. This actuator 18 includes an actuation rod 18*a* sliding in a body 18*b* and acting on a support 20 supporting the filling tube 11. As shown in the drawings, the upper end of the filling tube 11 is fixed on the support 20.

According to another characteristic of the invention, the exit passage 11*b* of the filling tube 11 is opened or closed using an obturation device 21 of all types. In the exemplary embodiment illustrated in the drawings, the obturation device 21 includes a rod 22 mounted coaxially inside the filling tube 11. This rod 22 is equipped at its lower part with an obturator 23 adapted to open or close the exit passage 11*b* of the filling tube depending on the position of the rod. The rod 22 is movably mounted in translation relative to the filling tube 11 using an actuator 25 which monitors at least the obturation of the exit passage 11*b* of the filling tube. This obturation actuator 25 moves the rod 22 so that the obturator 23 can open or close the exit passage 11*b* of the filling tube. To switch from the open position to the closed position of the exit passage 11*b*, the rod 22 is moved upwards relative to the filling tube 11 such that the obturator 23 cooperates with the lower end 11*a* in order to close its exit passage 11*b*. To switch from the closing position to the open position of the exit passage 11*b*, the rod 22 is moved downwards relative to the filling tube 11 such that the obturator 23 does not cooperate with the lower end 11*a* in order to open its exit passage 11*b*. Advantageously, the stroke of the rod 22 is adapted such that in the open position, the obturator 23 does not reduce the exit passage 11*b* of the filling tube 11.

The rod 22 is slidably guided by the support 20 on which the obturation actuator 25 is advantageously mounted. For example, the obturation actuator 25 is produced by an electric or pneumatic actuator.

According to one advantageous characteristic of the invention, the rod 22 forms part of the sealing system 17 which ensures the closing of the air return circuit 12 when the filling tube 11 occupies the high position called complete obturation position (FIG. 3) but which ensures the opening of the air return circuit 12 when the filling tube 11 is lowered relative to the spout endpiece 8 (FIG. 2). The lower end of the rod 22 is provided with a seal 17*a* forming part of the sealing system 17 and extending radially beyond the filling tube 11 to cooperate with the lower end 8*a* of the spout endpiece 8 in order to ensure the closing of the air return circuit 12.

According to one advantageous variant of embodiment, the obturator 23 and the seal 17*a* are produced by a common seal carried by the lower end of the rod 22. This common seal 23, 17*a* has a frustoconical shape with its central part obturating the filling tube 11 while its peripheral part closes the annular chamber 12*a* delimited between the filling tube 11 and the spout endpiece 8. This common seal 23, 17*a* is produced in any suitable manner to perform the described sealing functions. To switch from the open position to the closed position of the air return circuit 12, the filling tube 11 is moved upwards relative to the spout endpiece 8 such that the sealing system 17 ensures the closing of the lower part of the annular chamber 12*a* delimited between the spout endpiece 8 and the filling tube 11. In this closed position illustrated in FIG. 3, the lower end 11*a* of the filling tube occupies a higher level relative to the lower end 8*a* of the spout endpiece 8.

The filling machine I also includes a control circuit 28 connected to the chamber obturator 15, to the tank obturator 16, to the displacement actuator 18 of the filling tube 11 and to the obturation actuator 25 allowing the opening or closing of the exit passage of the filling tube 11. The control circuit 28 allows driving the operation of the chamber obturator 15, of the tank obturator 16, of the displacement actuator 18 of the filling tube 11 and of the obturation actuator 25 to implement a filling method according to the invention. The control circuit 28 also drives the sealing system 17 which ensures the closing of the air return circuit 12. In the illustrated example, the sealing system 17 is monitored by the filling tube 11 whose displacement is driven by the displacement actuator 18.

The following description describes a filling cycle of a container 2 according to the method according to the invention implemented with the machine I described above.

FIG. 1 illustrates a filling head 6 in a post or pre-filling position in which the exit passage 11*b* of the filling tube 11 is closed and the air return circuit 12 is also closed by the obturation device 21. The filling tube 11 occupies the high position called complete obturation position also illustrated in FIG. 3.

The filling method consists in making the neck 2*c* of the container 2 bear on the seat 9 of the filling head while engaging the spout endpiece 8 inside the container 2. To this end, the handling system 7 moves the container 2 to make its finish surface 2*d* bear on the seat 9. As illustrated more specifically in FIG. 4, the method consists in translating the filling tube 11 inside the container 2 from its high position called complete obturation position to its low position in the vicinity of the bottom of the container. The control circuit 28 thus drives the displacement actuator 18 to lower the filling tube 11 until the lower end 11*a* of the filling tube is located in the vicinity of the bottom of the container.

It should be noted that the lowering of the filling tube 11 leads to release the sealing between the filling tube 11 and the spout endpiece 8 since the seal 17*a* no longer cooperates with the spout endpiece 8 (FIG. 2). The annular chamber 12*a* is therefore no longer sealed so that the air return circuit 12 is put in communication with the interior of the container 2. It should be noted that the air return circuit 12 is at atmospheric pressure and includes a determined volume of liquid recovered during the previous filling cycle. Also, the air return circuit 12 is emptied of its liquid along the filling tube 11 during the downward movement of the filling tube 11 inside the container.

When the filling tube 11 occupies its low position, the exit passage 11*b* of the filling tube is opened in order to ensure the exit of the liquid (FIG. 5). To this end, the control circuit 28 drives the obturation actuator 25 to ensure the lowering of the rod 22 relative to the filling tube 11 so that the obturator 23 can open the exit passage 11*b* of the filling tube. The liquid can thus flow inside the container.

Advantageously, concomitantly with the opening of the exit passage of the filling tube, the air return circuit 12 is put in communication with the pressurized chamber 14 to ensure a slow flow of the liquid. The control circuit 28 closes the tank obturator 16 and simultaneously opens the chamber obturator 15. The pressure applied inside the container 2 by the pressurized chamber 14 and exerted on the liquid leaving the filling tube is such that it allows reducing the gravity flow of the liquid leaving the filling tube 11, by reducing the speed of the liquid leaving the filling tube 11; the impact of the liquid on the bottom of the container decreases, thus avoiding the creation of turbulences in the beginning of the filling. The level of the liquid inside the container 2 thus rises gradually with an upper surface remaining practically planar.

When the exit passage 11*b* of the filling tube 11 is immersed in the liquid, the air return circuit 12 is put at atmospheric pressure to increase the flow of the liquid. The control circuit 28 closes the chamber obturator 15 and simultaneously opens the tank obturator 16 (FIG. 6). It follows that the filling speed is accelerated without affecting the quality of the liquid since the liquid flowing from the exit passage 11*b* of the filling tube is immersed.

When the level of the liquid is such that the exit passage 11*b* of the filling tube 11 is immersed in the liquid, then the filling tube 11 is raised while keeping the exit passage 11*b* of the liquid immersed (FIG. 7). The control circuit 28 thus drives the displacement actuator 18 to raise the filling tube 11 towards its leveling position while keeping the exit passage 11*b* of the filling tube 11 immersed in the liquid. The filling thus continues without affecting the quality of the filling. The beginning of the raising of the filling tube 11 begins after a period determined by experimentation. Similarly, the filling tube 11 raising rate is determined by experimentation.

The filling method ends during a filling end phase occurring when the liquid level approaches the leveling position. Typically, this filling end phase begins when the liquid level reaches the start of the neck. During the filling end phase, the air return circuit 12 is put in communication with the pressurized chamber 14 to slow down the liquid flow (FIG. 8). The control circuit 28 closes the tank obturator 16 and simultaneously opens the chamber obturator 15. The pressure applied inside the container 2 by the pressurized chamber 14 and exerted on the liquid leaving the filling tube is such that it allows reducing the gravity flow of the liquid leaving the filling tube 11, thus avoiding the creation of turbulences at the end of the filling.

The filling tube 11 continues its displacement upwards, under the action of the displacement actuator 18, up to its leveling position. Of course, the filling tube 11 is moved such that the exit passage 11*b* of the filling tube 11 remains immersed. According to one advantageous variant of embodiment, the filling tube 11 is moved so that, in the leveling position, the lower end 11*a* of the filling tube is at the level of the lower end 8*a* of the spout endpiece 8 (FIG. 9). The level of the liquid inside the container 2 thus rises gradually to stabilize at the same level as the lower end 8*a* of the filling tube.

The method consists in waiting for the stabilization of the liquid level at the lower end 11*a* of the filling tube 11. The liquid continues its path in the air return circuit 12 by flowing back to the annular chamber 12*a* and even in part of the connection pipe 12*b* (FIG. 10).

After the leveling operation, the method consists of closing the air return circuit 12 as well as the exit passage 11*b* of the filling tube 11 to stop the exit of the liquid. To this end, the control circuit 28 drives the obturation actuator 25 to ensure the raising of the rod 22 relative to the filling tube 11 so that the obturator 23 can close the exit passage 11*b* of the filling tube (FIG. 11). Simultaneously, the control circuit 28 drives the displacement actuator 18 to raise the filling tube 11 such that the seal 17*a* cooperates with the spout endpiece 8 in order to obturate the air return circuit 12 and particularly the annular chamber 12*a*. Thus, the filling tube 11 is raised up to the high position called complete obturation position as illustrated in FIG. 3.

The filling of the container being completed, the control circuit 28 closes the chamber obturator 15 and opens the tank obturator 16 in order to relieve the pressure in the air return circuit 12. The filled container is released of the spout endpiece 8 after its filling using the handling system 7, to allow the engagement of a new container to be filled.

The object of the invention thus allows filling and bringing to a desired level a container without using a vacuum or a vacuum pump. The filling level is made by pressure balance when the liquid level reaches the lower end of the filling tube 11.

The invention is not limited to the examples described and represented because various modifications can be made thereto without departing from its framework.

The invention claimed is:

1. A method for filling containers (2) using a filling liquid (1) stored in a tank (3) and delivered using at least one filling head (6) including a spout endpiece (8) provided with a bearing seat (9) for a neck of a container, the spout endpiece (8) being crossed by a filling tube (11) connected to the tank and delimiting with the spout endpiece, at least part of an air return circuit (12), the filling tube delimiting an exit passage (11*b*) for the liquid which is opened or closed by means of an obturation device (21), the method including the following steps for the filling of a container:

making the neck of the container bear on the seat (9) by engaging the spout endpiece of the spout (8) inside the container (2);

translating the filling tube (11) inside the container from a high position to a low position in the vicinity of the bottom (2*a*) of the container;

putting in communication with the interior of the container, the air return circuit (12) put at atmospheric pressure so that it empties of its liquid;

when the filling tube (11) occupies its low position, opening the exit passage (11*b*) of the filling tube in order to ensure the exit of the liquid and put the air return circuit (12) in communication with a pressurized chamber (14) to ensure a slow flow of the liquid;

when the exit passage (11*b*) of the filling tube (11) is immersed in the liquid, putting the air return circuit (12) at atmospheric pressure to increase the flow of the liquid;

moving the filling tube (11) while keeping the liquid exit passage (11*b*) immersed, towards a leveling position for which the filling tube is engaged inside the container at a depth corresponding to the level of the liquid inside the container;

during the filling end phase, putting the air return circuit (12) in communication with the pressurized chamber (14) to slow down the flow of the liquid and move the filling tube (11) to its leveling position;

waiting for the stabilization of the liquid level with a return of liquid in the air return circuit (12) before closing the air return circuit;

and closing the exit passage (11*b*) of the filling tube to stop the exit of the liquid.

2. The filling method according to claim 1, according to which the container (2) is disengaged from the spout endpiece (8) after its filling before the engagement of a new container to be filled.

3. The filling method according to claim 1, according to which the filling tube (11) is moved so that, in the leveling position, the lower end (11*a*) of the filling tube is at the level of the lower end (8*a*) of the spout endpiece (8).

4. The filling method according to claim 1, according to which the bearing seat (9) is mounted in an adjustable position relative to the lower end (8*a*) of the spout endpiece (8) to adjust the level of the liquid inside the container.

5. The filling method according to claim 1, according to which the filling tube (11) is moved from its leveling position to the high position in order to ensure the closing of the air return circuit (12) occurring automatically when the filling tube switches from its leveling position to the high position.

6. The filling method according to claim 1, according to which the filling tube (11) is moved such that the high position corresponds to the leveling position.

7. The filling method according to claim 1, according to which the translation of the filling tube (11) inside the container from the high position to the low position ensures the communication of the air return circuit (12) with the interior of the container.

8. The filling method according to claim 1, according to which the container (2) is sealingly bearing on the seat (9) at least as long as the exit passage (11*b*) of the filling tube (11) is open.

9. The filling method according to claim 1, according to which the exit passage (11*b*) of the filling tube is opened or closed by an obturator (23) carried by a rod (22) movable in translation relative to the tube in order to open or close the exit passage depending on the position of the rod (22) relative to the filling tube (11).

10. A machine for filling containers (2) using a filling liquid (1) stored in a tank (3), including at least one filling head (6), each filling head including:

a spout endpiece (8) provided with a bearing seat (9) for a neck of a container;

a filling tube (11) connected to the tank and passing through the spout endpiece (8) to delimit with the spout endpiece, part (12*a*) of an air return circuit (12) connected either to the atmospheric pressure via a tank obturator (16), or to a pressurized chamber (14) via a chamber obturator (15), the filling tube (11) being vertically movable by means of a displacement actuator (18) between, on the one hand, a high position and, on the other hand, a low position in the vicinity of the bottom of the container, the filling tube (11) delimiting an exit passage (11*b*) for the liquid which is opened or closed by means of an obturation device (21);

a sealing system (17) ensuring the closing of the air return circuit (12) when the filling tube (11) occupies the high closing position;

a control circuit (28) connected to the chamber obturator (15), to the tank obturator (16), to the displacement actuator (18), to the obturation device (21) and to the sealing system (17) for:

moving the filling tube (11), during an initial filling phase, from its high closing position to its low position and driving the obturation device (21) to open the exit passage (11*b*) of the filling tube (11), and putting the air return circuit (12) in communication with the pressurized chamber (14);

putting the air return circuit (12), when the exit passage (11*b*) of the filling tube is immersed in the liquid, to atmospheric pressure and moving the filling tube (11) towards its leveling position while keeping the liquid exit passage (11*b*) immersed;

putting the air return circuit (12), during the filling end phase, in communication with the pressurized chamber (14) and bringing the filling tube (11) to a leveling position of the liquid inside the container, with a return of liquid in the air return circuit (12), driving the sealing system (17) to close the air return circuit and driving the obturation device (21) to close the liquid exit passage.

11. The filling machine according to claim 10, according to which the obturation device (21) includes a rod (22) mounted inside the filling tube (11) and equipped at its lower part with an obturator (23) and movable in translation relative to the filling tube (11) by means of a filling actuator (25) so that the obturator (23) can open or close the exit passage (11*b*) of the filling tube (11) depending on the position of the rod.

12. The filling machine according to claim 11, according to which the filling tube (11) is provided with a support (20) for the rod (22) and for the filling actuator (25).

13. The filling machine according to claim 10, according to which the sealing system (17) includes a seal (17*a*) carried by the rod (22) to close the air return circuit (12) when the filling tube (11) switches from its leveling position to its high closing position.

14. The filling machine according to claim 10, according to which the bearing seat (9) is mounted with a possibility of adjustment relative to the lower end (8*a*) of the spout endpiece (8) to allow adjusting the level of the liquid in the container.

15. The filling machine according to claim 10, according to which it includes a container handling system (7) for engaging each container (2) in the spout endpiece (8) and releasing each of the containers after their filling.

* * * * *